United States Patent [19]

Czeschka et al.

[11] Patent Number: 4,585,293

[45] Date of Patent: Apr. 29, 1986

[54] ELASTIC PRESS-IN FOR THE SOLDERLESS CONNECTION OF THE WINDING POSTS OF ELECTRIC CONNECTORS OR THE LIKE WITH THROUGH-CONNECTED PRINTED WIRING BOARDS

[75] Inventors: Franz Czeschka, Rechberghausen; Egon Reichenecker, Adelberg; Reinhard Zorn, Rechberghausen, all of Fed. Rep. of Germany

[73] Assignee: ERNI Elektroapparate GmbH, Adelberg, Fed. Rep. of Germany

[21] Appl. No.: 549,239

[22] Filed: Nov. 4, 1983

[30] Foreign Application Priority Data

Nov. 6, 1982 [DE] Fed. Rep. of Germany ..... 3241061

[51] Int. Cl.[4] ..... H01R 4/24

[52] U.S. Cl. ..... 339/221 R

[58] Field of Search ..... 339/17 C, 220 R, 221 R, 339/221 M

[56] References Cited

U.S. PATENT DOCUMENTS

| | | | |
|---|---|---|---|
| 2,139,535 | 12/1938 | Young | 339/221 R |
| 3,824,554 | 7/1974 | Shoholm | 339/221 R |
| 4,343,530 | 8/1982 | Leger | 339/220 R |

FOREIGN PATENT DOCUMENTS

| | | | |
|---|---|---|---|
| 0059462 | 9/1982 | European Pat. Off. | 339/221 R |
| 2656736 | 7/1977 | Fed. Rep. of Germany . | |
| 8105896 | 4/1982 | Fed. Rep. of Germany . | |

OTHER PUBLICATIONS

"Compliant Pin Concepts", AMP Inc., presented at Electronic Components Conference, Atlanta, Georgia, May 11–13, 1981.

Sicher Auch Bei Schnellen Pulsen, pp. 16, 17, 18, 21, 22, by Dipl.-Ing. Horst Nowacki (Germany).

*Primary Examiner*—Gil Weidenfeld
*Assistant Examiner*—Gary F. Paumen
*Attorney, Agent, or Firm*—Toren, McGeady, Stanger, Goldberg & Kiel

[57] ABSTRACT

To create an insertable elastic section for connecting contact pins into through-openings in a printed circuit board, an axially extending section of a post or pin is deformed to provide an axially extending U-shaped section. The pin is provided with a regular transverse section from which the U-shaped section is deformed. The original shape of the pin may be rectangular. The deformation is carried out in a pair of die parts. The axially extending U-shaped section is divided into a bight part or base with a pair of legs extending outwardly from the opposite sides of the base. The outside surfaces of the legs are shaped to provide linear contact with the surface of an opening through a printed circuit board with the contact being afforded at the opposite ends of the legs. Transition sections interconnect the legs to the base and are provided with a reduced wall thickness as compared to the legs for enhancing the elasticity of the legs. The elasticity of the U-shaped section accommodates the diameter differences in the openings through the printed circuit board.

3 Claims, 5 Drawing Figures

ELASTIC PRESS-IN FOR THE SOLDERLESS CONNECTION OF THE WINDING POSTS OF ELECTRIC CONNECTORS OR THE LIKE WITH THROUGH-CONNECTED PRINTED WIRING BOARDS

BACKGROUND OF THE INVENTION

The present invention is directed to a contact pin for insertion into contacting engagement with a through-opening in a printed circuit board. A deformed elastic section of the pin affords the contact between the pin and the opening in the board.

Insertable elastic pins of the type mentioned above have the basic task of compensating for manufacturing tolerances in the diameter of the metallic surfaced through-openings in printed board circuit; they have been known for some time, for example, from DE-OS 26 56 736 in the form so that over a certain partial section of the post or pin length they have an approximately C-shaped cross-section, which, initially, permits a diameter variation or diameter adaptation to different hole diameters in the printed boards and secondly, by a snug fit in the board opening also affords the required contact pressure. Now while the task of the diameter adaptation may be considered more or less well resolved in this known design, the integrity of the contact itself is very insufficient; this is attributable to the fact that the specific contact pressure of the C-shaped section of the post with the hole wall is very low due to the relatively large contact area, so that a so-called hermetic union can never result, but instead one must reckon with corrosion phenomena at the contact locations.

SUMMARY OF THE INVENTION

It is, therefore, the object of the present invention to eliminate the above cited disadvantages of the pins known from DE-OS 26 56 736 and to provide a pin form which along with high diameter elasticity in the cross-section also results in good edge compression contact with printed board openings.

This problem is solved by the subject matter indicated in the patent claims, and the specific details and advantages of which are explained more specifically in the description of two embodiments.

Besides the above-mentioned DE-OS 26 56 736, it is indeed further known from the likewise older DE-GM (German Utility Model) 81 05 896 how to form insertable pins with an approximately M-, N- or X-shaped cross section as the contact zone, that is, to give the basic cross-section an edge, in order to get good contact points. The disadvantage of this design is, however, that these cross-sectional shapes have only a very low elasticity or deformability, because in the required bending regions there are still relatively strong (thick) material zones which stiffen the basic shape.

DETAILED DESCRIPTION OF THE INVENTION

Figure 2:
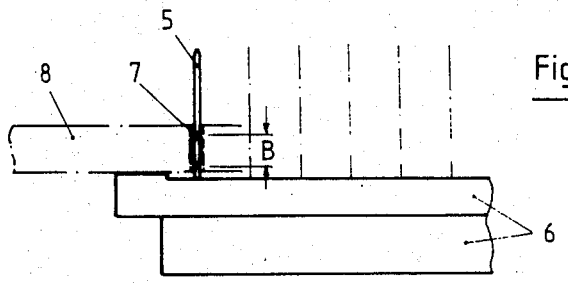
FIG. 2 is a partial view of a plug connector including the wound posts according to the invention.
Figure 3:
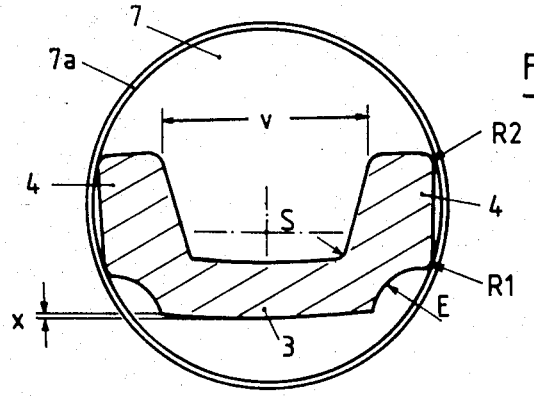
FIG. 3 is a cross-sectional view of the deformed section of the post in a printed circuit board hole.
Figure 4:
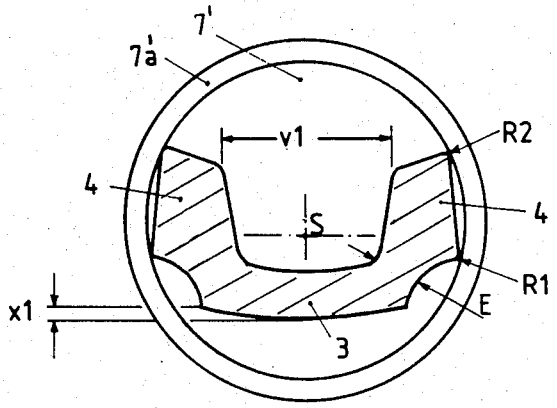
FIG. 4 is a view similar to FIG. 3 with the post inserted into a smaller hole.
Figure 5:
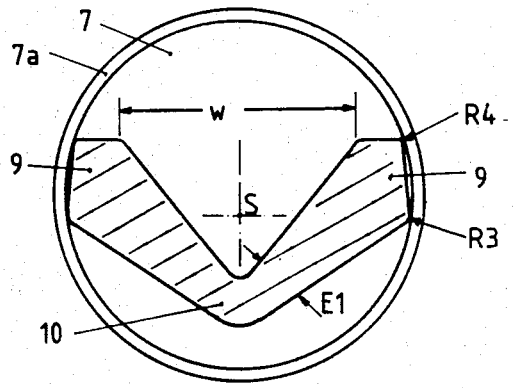
FIG. 5 is a cross-sectional view of another embodiment of the deformed post.

An axially extending elastic deformed section B (FIG. 2) of a wound post or pin 5 of a plug connector 6 according to the invention, is illustrated in transverse section in FIGS. 3 to 5. The plug connector 6 is illustrated schematically in FIG. 2, and has the outstanding feature that the basic cross-sectional form is appoximately U-shaped, 3,4 or V-shaped 9,10. The U-shaped section is made up of a bight portion or base 3 with legs 4 extending outwardly from the opposite base. A transition portion E connects the opposite sides of the base 3 with the legs 4 and has a reduced thickness as compared with the legs.

The V-shaped section in FIG. 5 has a base 10 with legs 9 extending outwardly from the base. In FIGS. 3 and 4 the outside surface of the transition portion E is concave and is formed by an arc of a circle. The outwardly directed edges $R_1$, $R_2$ at the opposite ends of each of the free legs 4 form contact lines as shown with rounded surfaces, however, the contact lines need not be rounded. It is further provided according to the invention that the wall thickness of the base 3 or 10 is equal to or smaller than that of the transition portions E or $E_1$. The material of the base 3, 10 connecting and thereby stiffening the legs 4, 9 extends outside the center of gravity S. By this arrangement a transverse elasticity is obtained which, as is evident especially from FIGS. 3 and 4, makes it possible to press or insert contact pins of equal size into the metallic surfaced walls *7a*, *7a'* of different size board openings 7, 7' in such a way that at the contact edges $R_1$, $R_2$ or respectively $R_3$, $R_4$, gastight and hence corrosion-proof junctions or contact surfaces are formed. Thus, whether a circuit board opening is smaller or larger—due to the manufacturing tolerances—will determine how the width w changes when the pin is inserted into a board opening.

Figure 1:
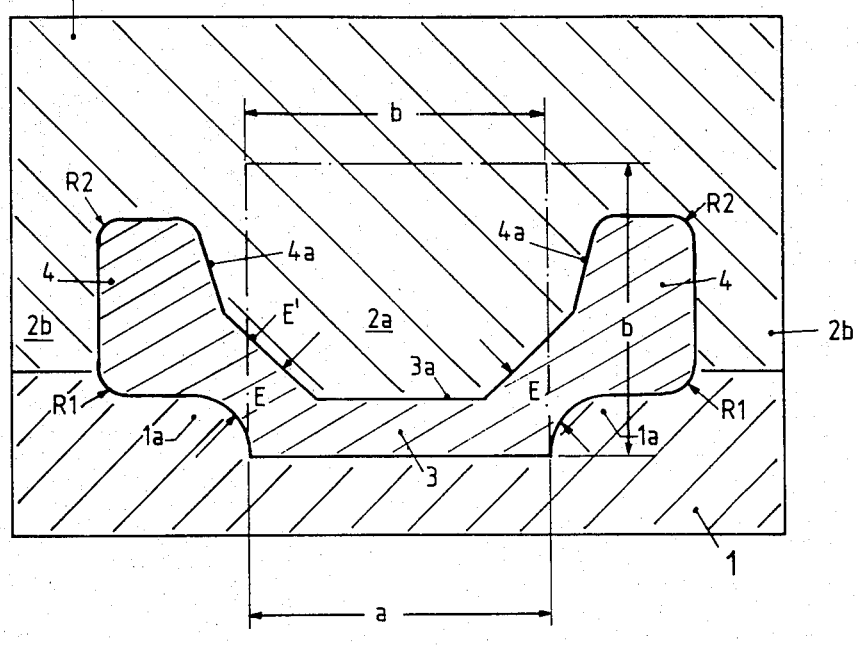
FIG. 1 shows the cross section, according to the invention, of the contact section of a wound post or pin with a shaping die.

In a simple, exact and hence wasteproof manner, the elastic deformed sections B according to the invention are to be manufactured in a die according to the schematic representation in FIG. 1. The die is formed by a die bottom part 1 which fixes the pin width b in a cutout or recess of an equal width a, with formed-in bulges 1*a* forming the elastic transition portion E between the base 3 and the legs 4 and a correlated die top part 2, whose centered ram 2*a* serves essentially to form the profile or inside surface 3*a*, E', 4*a* of the deformed section B. The lateral regions 2*b* of top part 2 serves to form the legs 4 with their outer contact edges $R_2$. In this manner, individual execution of the shaped deformed sections B on the wound posts or pins 5 during their manufacture or subsequent(ly) on plug connectors 6 of any model already equipped with posts 5 is possible, as has not been the case with the insertable pins known to-date.

We claim:

1. An elastic plug connector for solder-free connection in a printed circuit board comprising an axially extending pin for insertion into a through-opening in the printed circuit board, said pin having a regularly shaped transverse cross-section with a part of said pin having an axially extending deformed elastic section extending transversely outwardly from said regular shaped section and arranged to effect contact with the surface within the opening in the printed circuit board, said deformed elastic section being U-shaped transverse to the axial direction of said pin and said U-shaped section comprising a base with a pair of opposite laterally spaced axially extending sides, and an axially extending leg extending outwardly from each of said opposite sides and disposed transversely of said base, said base having a generally planar outside surface, said legs disposed generally parallel to one another and being elastically displaceable relative to said base, a transition section interconnecting each said leg and said base, said transition sections have a wall thickness at least equal to the wall thickness of said base, said U-shaped section having an inside surface formed by said base, said transition sections, and said legs, and the inside surface of said transition sections extend obliquely outwardly from said base to said legs and the outside surface of said transition sections being a concavely shaped arcuate surface between said base and said legs, each said leg having a generally planar outside surface extending transversely of said base from said transition sections interconnecting said base and leg and defining oppositely facing outside surfaces of said legs, each said planar outside surface having a pair of opposite ends spaced apart in the direction of said legs extending from said base with one of said opposite ends being located at the connection of said transition section to said leg and the other said opposite end being located at the free end of said leg and said opposite end outside surfaces being rounded, said legs have a thickness extending transversely of the axial direction of said pin greater than the corresponding thickness of said transition sections, and said U-shaped section having a center of gravity with the center of gravity being spaced from said base and between said legs whereby when said pin is inserted into an opening in the printed circuit board, said U-shaped section deforms with the only contact between said pin and the opening being provided by the opposite ends of said planar outside surfaces of said legs.

2. An elastic plug connector, as set forth in claim 1, wherein said base extending between said transition sections has a dimension equal to the corresponding dimension of the regularly shaped section of said pin.

3. An elastic plug connector, as set forth in claim 2, wherein said regularly shaped transverse cross-section of said pin is rectangularly shaped.

* * * * *